US006357866B1

(12) United States Patent
van Rensburg

(10) Patent No.: US 6,357,866 B1
(45) Date of Patent: Mar. 19, 2002

(54) DROPLET GENERATOR

(75) Inventor: Richard Wilhelm Janse van Rensburg, Cambridgeshire (GB)

(73) Assignee: Scitex Digital Printing, Inc., Dayton, OH (US)

( * ) Notice: Subject to any disclaimer, the term of this patent is extended or adjusted under 35 U.S.C. 154(b) by 0 days.

(21) Appl. No.: 09/271,710

(22) Filed: Mar. 18, 1999

(30) Foreign Application Priority Data

Mar. 19, 1998 (GB) ..... 9805783

(51) Int. Cl.[7] ..... B41J 2/02
(52) U.S. Cl. ..... 347/75
(58) Field of Search ..... 347/75, 74, 68, 347/70, 71

(56) References Cited

U.S. PATENT DOCUMENTS 3,946,398 A * 3/1976 Kyser et al. ..... 347/70
4,245,227 A * 1/1981 Krause ..... 347/75
5,746,373 A * 5/1998 Sanada ..... 347/75 X

FOREIGN PATENT DOCUMENTS

JP 55-109668 * 8/1980 ..... 347/70
JP 56-69178 * 6/1981 ..... 347/70
JP 58-31763 * 2/1983 ..... 347/68

* cited by examiner

*Primary Examiner*—David F. Yockey
(74) *Attorney, Agent, or Firm*—Barbara Joan Haushalter

(57) ABSTRACT

A droplet generator for generating a plurality of streams of ink droplets in a continuous ink jet printer comprises a stimulator plate, and the capability of supplying ink to the stimulator plate. The stimulator plate is substantially planar and comprises a substrate, a flexible membrane having a line of nozzles, and an actuator for vibrating the membrane at a resonant frequency. During use, a standing wave is generated such that the line of nozzles is positioned on a locus of uniform vibrational amplitude.

6 Claims, 8 Drawing Sheets

DROPLET GENERATOR

TECHNICAL FIELD

The present invention relates to a droplet generator for generating streams of ink droplets in a continuous ink jet (CIJ) printer, and a method of operating a droplet generator.

BACKGROUND ART

Conventionally, a CIJ printer comprises a print head containing an ink-receiving cavity and a row of nozzles that lead from the cavity through one face of the head. Ink is fed into the cavity at a high pressure (typically 2 to 3 bar) and emerges through the nozzles as a series of high velocity jets. The head is designed to be highly resonant and it is driven at a resonant frequency by one or more piezoelectric transducers. The resonance of the head modulates the pressure of the ink as it emerges from the nozzles and this causes the ink jets to break up into streams of droplets at the modulation frequency.

Selected ink droplets may be electrostatically charged, so that they can be deflected by an electric field. Deflected droplets are collected and this collected ink is conditioned and recycled for re-use. Uncharged droplets are not deflected by the electric field and thus continue in a straight line until they strike a substrate, thereby printing an image on the substrate.

CIJ printers operate at very high speeds (up to ten times faster than conventional drop-on-demand ink jet printers) but are very much more expensive than drop-on-demand printers. They are therefore used mainly where very large print volumes are required: for example, they are sometimes used to print information on packets of food or pharmaceuticals as the packets move along a production line.

Conventional CIJ printers have a number of other drawbacks, apart from their high cost. In particular, such printers are very sensitive to factors that might affect the resonance of the print head, such as component manufacturing tolerances and assembly conditions, and sources of acoustic disturbance in the print head such as cavitation or the presence of air bubbles. Any such imperfections can cause serious deterioration in print quality. Construction and maintenance of the print head is therefore difficult and expensive and very careful conditioning of the ink is required.

The above difficulties arise mainly from the need to generate a defined mode of resonance in which the pressure modulations are identical at all of the nozzles. All other modes of resonance should be suppressed. This is extremely difficult to achieve in practice since three dimensional structures like conventional CIJ print heads have very many possible modes of resonance having closely spaced resonant frequencies. It is therefore very difficult to drive the desired resonant mode without also driving various other unwanted modes.

In order to allow only the desired resonant mode to be driven, conventional CIJ heads are designed to produce very sharp resonances. The bandwidth of the possible drive frequencies for each resonant mode is thereby reduced, which makes it possible to drive the desired mode without driving nearby unwanted modes. An undesirable consequence of this is however that the head is very sensitive to minor variations in the characteristics of the ink or the presence of air bubbles, as mentioned above. The head is also very expensive to manufacture and maintain.

These difficulties also place practical limits on both the size and the operational frequency of the print head. The maximum operational frequency achievable at present with a standard 50 mm (2") print head is normally about 100 kHz and the maximum practical length for a commercially manufactured print head is thought to be approximately 100 mm (4").

It is therefore desirable to provide a longer print head that is capable of operating at higher frequencies. However, this would require further improved inhibition of unwanted resonance modes, when such inhibition is already difficult with print heads of conventional dimensions.

SUMMARY OF THE INVENTION

It is an object of the present invention to provide a droplet generator that is suitable for use as a print head in a CIJ printer, and a method of operating such a printer, that mitigates at least some of the afore-mentioned disadvantages.

In accordance with one aspect of the present invention, there is provided a droplet generator for generating streams of ink droplets in a continuous ink jet printer, the droplet generator including a flexible stimulator plate having a plurality of nozzles that extend through the plate from one face to the other, said nozzles being arranged in at least one substantially rectilinear line, means for supplying ink under pressure to the nozzle-bearing region of one face of the stimulator plate, and actuator means for generating bending vibrations in the stimulator plate, said actuator means including at least one electromechanical transducer that is arranged to expand and contract in a direction parallel to the plane of the stimulator plate, the or each said line of nozzles being located to coincide, during use, with a locus of substantially uniform vibrational amplitude and phase, whereby substantially identical streams of ink droplets are ejected from the nozzles.

The piezoelectric transducers are arranged to expand or contract in the plane of the stimulator plate (i.e. perpendicular to the local surface normal of the stimulator plate) when an electric field is applied thereto. This causes bending of the stimulator plate, thereby driving the vibrations of the generator in a simple and efficient manner. Preferably, a standing wave is generated that provides at least one substantially rectilinear antinode or antinodal line, that is a point or a locus of points vibrating in phase whose amplitude is a local maximum when traversed in at least one direction in that portion of the flexible membrane that is contacted by the ink. The line of nozzles is preferably positioned parallel to and either adjacent to or on an antinodal line of said standing wave.

Providing a linear array of nozzles that coincides with a locus of substantially uniform vibrational amplitude ensures that all the nozzles experience similar vibrations. The pressure modulations in the ink jets emerging from the nozzles are therefore substantially identical, resulting in identical streams of ink droplets.

Because the stimulator plate is, as far as its acoustic properties are concerned, a two dimensional structure, it has many fewer possible modes of resonance than a conventional three-dimensional droplet generator and the frequencies of those resonant modes are correspondingly much more widely spaced. It is therefore relatively easy to drive only the desired mode without driving other undesired modes. Advantageously, the vibration of the stimulator plate generates a stimulation pressure in ink directly in contact with a region of the flexible plate member that narrowly encompasses the nozzles. In this way the path length traveled through the ink by the acoustic energy is kept to a minimum, thereby also providing a decoupling of the stimulation pressure so produced from the acoustic effects of the other, more distant, boundaries of the ink. This is unlike conventional CIJ droplet generators, in which the ink itself plays an acoustically active role in the resonance of the stimulator and which are thus very sensitive to changes in conditions pertaining, such as in the acoustic characteristics of all the solid boundaries of the ink or to the accidental intrusion of a bubble of air.

This means that in the new generator a very sharp resonance is not necessary and the droplet generator is thus far less sensitive to factors such as the consistency of the ink or the presence of air bubbles, which generally have a very serious effect on the performance of a conventional droplet generator. The new droplet generator is therefore cheaper and more reliable in operation and does not require such complicated ink conditioning apparatus.

A further advantage resulting from the use of an acoustically two-dimensional stimulator plate is that the vibrating part of such a structure can have a much lower mass and acoustic impedance than in a conventional droplet generator, the acoustic impedance of the vibrating flexible plate member being comparable to that of the actuators. These circumstances mean that the amount of vibrational energy stored in the stimulator plate is smaller than that stored in conventional CIJ stimulators and that a larger amount of energy can be transferred per cycle in either direction between the actuators and the vibrating flexible plate member. This makes it possible to control the vibration of the stimulator directly by feeding appropriate drive signals to the actuators, so allowing unwanted modes to be actively suppressed. Conventional CIJ droplet generators have an acoustic impedance at their operating frequency that is much larger than the acoustic impedance of the piezoelectric actuators, making resonance control by means of an electrical drive signal supplied to the actuators much more difficult to achieve.

Finally, the new droplet stimulator plate can operate successfully at higher frequencies than conventional droplet generators (for example, at frequencies exceeding 150 kHz), with no practical upper limit on the dimension of the stimulator plate and the droplet generator in the direction of the line of nozzles.

Other objects and advantages of the invention will be apparent from the following description, the accompanying drawing and the appended claims.

DETAILED DESCRIPTION OF THE PREFERRED EMBODIMENTS

Figure 1:
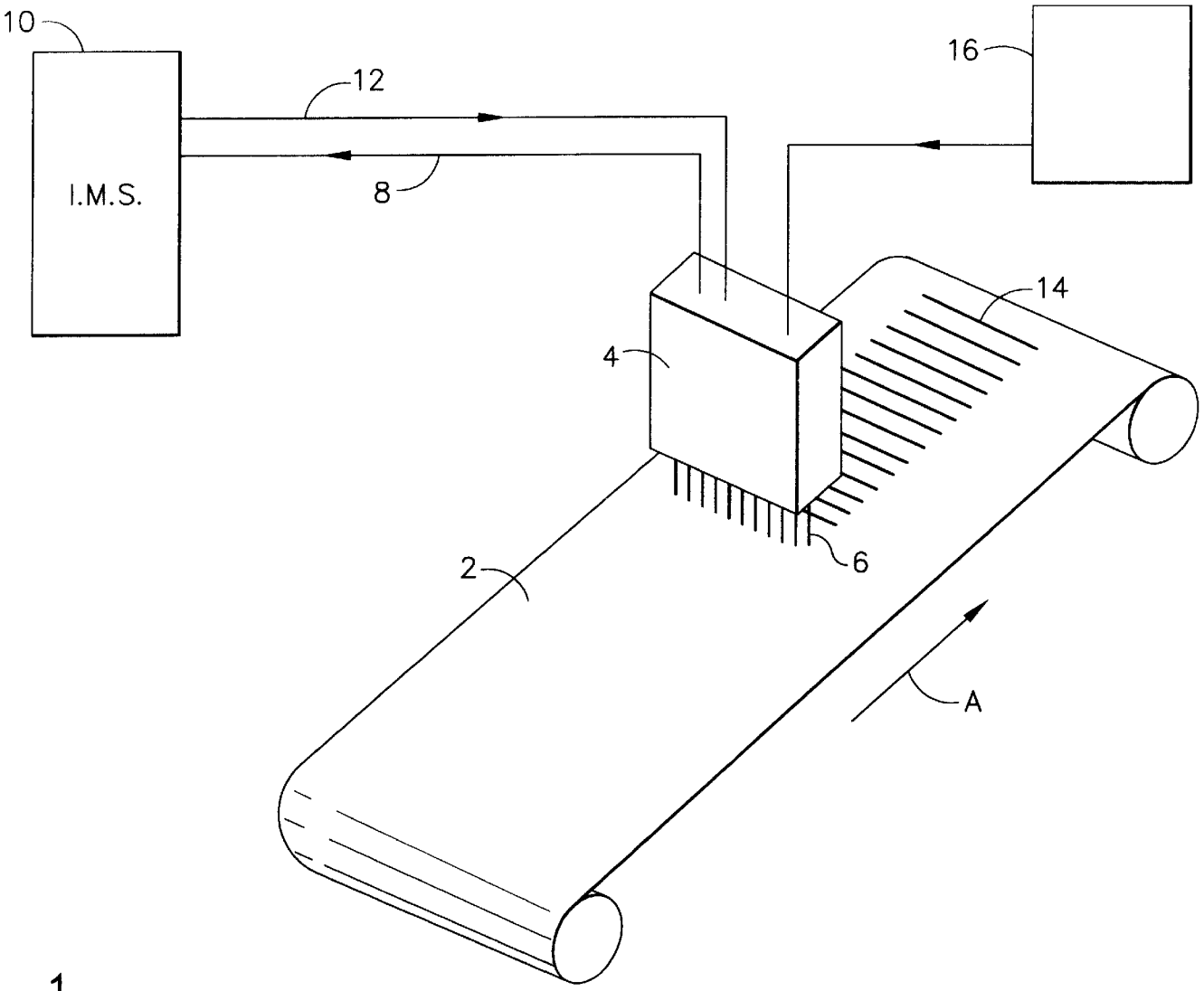
FIG. 1 illustrates schematically the main components and layout of a CIJ printer.

In accordance with the present invention, the stimulator plate and actuator means are a single component comprising an electromechanical transducer in the form of a flexible plate having a plurality of nozzles that extend through the plate from one face to the other. Such a stimulator plate is a very simple structure.

Alternatively, the stimulator plate and the actuator means may comprise separate components, the actuator means including at least one electromechanical transducer that is mounted on a face of the stimulator plate. One or more electromechanical transducers may be mounted on each face of the stimulator plate.

The stimulator plate may include a substrate on which said actuator means is mounted, said substrate having an aperture, and a flexible membrane mounted on said substrate and covering said aperture, wherein said nozzles extend through the region of the flexible membrane that covers said aperture.

In one embodiment of the present invention, the stimulator plate is substantially rectangular and the line of nozzles extends parallel to the longitudinal axis of the stimulator plate. Preferably, the line of nozzles and the longitudinal axis of the stimulator plate are substantially collinear with the central antinodal line of the membrane. Such an arrangement provides for large pressure modulations in the ink emerging from the nozzles. And, advantageously, at least one electromechanical transducer is provided on each side of the longitudinal axis.

The stimulator plate may include a plurality of actuators. The actuators may be arranged to ensure that a large amount of energy is coupled into the desired resonant mode and very little is coupled into undesired modes. For example, in the case of a rectangular stimulator plate, a row of actuators may be provided on either side of the longitudinal axis of the stimulator plate. Actuators may also be provided on both of the large faces of the stimulator plate. Different parts of each actuator may also be supplied with drive signals of opposite polarity to induce the desired mode, or alternatively separate actuators having amplitude and phase-shifted drive signals may be provided on different parts of the stimulator plate. The actuator means may comprise piezoelectric transducers. Alternatively, electrostrictive or magnetostrictive transducers may be employed.

In a construction employing separate substrate and flexible membrane, the flexible membrane may be bonded to a substrate of, for example, stainless steel. The membrane may extend across an aperture in the substrate.

Preferably, the shape and location of each transducer is arranged to stimulate bending waves whose direction of propagation is substantially perpendicular to the line of nozzles, so coupling more energy into the desired mode and less into the undesired modes. This may be achieved for example by increasing the longitudinal dimensions of the transducers or by configuring the shape of the drive electrodes for the transducers appropriately.

In a further preferred embodiment of the present invention, the stimulator plate possesses localized changes in acoustical impedance to such bending waves along a line or lines substantially parallel to the line(s) of nozzles and which are separated such that the bending waves are at least partially reflected therefrom to form standing waves with lines of nodes and/or antinodes substantially parallel to the line(s) of nozzles. Such discontinuities may, for example, be produced by changes in the elastic properties or the thickness of the stimulator plate or by it having edges that are substantially parallel to the line(s) of nozzles.

The stimulator plate may include sensing means for sensing flexure of the stimulator plate, drive means for driving the actuator means and control means for controlling the drive means in accordance with the sensed flexure of the stimulator plate. For example, a sense electrode may be provided on the piezoelectric transducers to sense electric potentials, currents or charges generated by flexure of the transducers. Sense electrodes may be used to sense both the wanted mode and unwanted modes. The sense electrodes may be pseudo-randomly distributed over the stimulator plate, to detect many different resonant modes.

The control means may be used to control operation of said actuator means in accordance with the sensed flexure of the stimulator plate. The drive signals fed to the actuators can thus be adjusted to enhance the desired mode and to suppress any undesired modes. To the extent that they suppress undesired modes, this is a form of 'active damping'. The drive signals fed to the actuators can thus be adjusted to enhance the desired mode and to suppress any undesired modes.

The control means may be arranged to control the amplitude and phase of the driving signals applied to said actuator means in accordance with the distribution of displacement amplitude and relative phase of the stimulator plate as sensed by said sensing means in order to aid in the suppression of unwanted modes of vibration of the stimulator plate.

Advantageously, the stimulator plate includes passive vibration damping materials. In a construction employing separate substrate and flexible membrane, a damping layer may for example be provided between the flexible membrane and the substrate, or between the actuators and the substrate, or inside the substrate, to absorb energy from the vibrations. This tends to eliminate vibrations that are not directly driven by the actuator, so helping to suppress undesired modes. The provision of damping means that the new generator behaves like a driven damped oscillator and not like a highly tuned resonator as in current CIJ droplet generators.

In accordance with one embodiment of the present invention, the stimulator plate has anisotropic acoustic properties, so that the propagation speed of vibrations is different in the transverse and longitudinal directions. The substrate may for example be provided with an internal structure, such as laminations, or with surface formations, such as grooves or ridges. To provide this anisotropy the separation of such internal structures as grooves or ridges is preferably chosen to be smaller than one half-wavelength of the bending waves propagating in the longitudinal direction in that region of the stimulator plate. The purpose of the acoustic anisotropy is to provide further means to separate the frequencies and to increase the selective damping of the unwanted longitudinal modes from that of the desired transverse mode.

The stimulator plate may be mounted on a manifold having a cavity for supplying ink to the stimulator plate. The manifold may include vibration damping materials or otherwise be designed to inhibit resonance. In any case, it is not essential for the manifold to be highly resonant, in contrast with earlier CIJ print heads.

The stimulator plate may include an inner nozzle-bearing part and a peripheral part on which said actuator means is mounted, said manifold being attached to the stimulator plate between said inner and peripheral parts. This arrangement is particularly well suited for use in a print head to which ink is supplied with a significant bias pressure.

Advantageously, the thickness of the stimulator plate in the nozzle-bearing region of the plate satisfies the inequality:

$$\sum_i \left(\frac{r_i}{c_i}\right) < \frac{1}{f}$$

where $t_i$, is the thickness of the ith layer of material in the stimulator plate and $c_i$, is the speed in that layer, at the operating frequency f, of either compressional or shear waves propagating the layer in the direction of its thickness.

Preferably, the thickness of the stimulator plate in the nozzle-bearing region of the plate satisfies the inequality:

$$\sum_i \left(\frac{t_i}{c_i}\right) < \frac{1}{2f}$$

According to the present invention there is further provided a method of operating a droplet generator to generate streams of ink droplets for use in a continuous ink jet printer, the droplet generator including a flexible stimulator plate having a plurality of nozzles that extend through the plate from one face to the other, said nozzles being arranged in at least one substantially rectilinear line, means for supplying ink under pressure to the nozzle-bearing region of one face of the stimulator plate, and actuator means for generating bending vibrations in the stimulator plate, said actuator means including at least one electromechanical transducer that is arranged to expand and contract in a direction parallel to the plane of the stimulator plate, wherein during operation the stimulator plate is vibrated such that said line of nozzles coincides with a locus of substantially uniform vibrational amplitude and phase, whereby substantially identical streams of ink droplets are ejected from the nozzles.

According to a further aspect of the invention there is provided a droplet generator including a stimulator plate for generating a plurality of streams of liquid droplets, and means for supplying liquid to the stimulator plate, wherein the stimulator plate is substantially two-dimensional and includes a flexible membrane having a plurality of nozzles that extend therethrough, the nozzles being arranged in a line, and at least one actuator means for vibrating the membrane said line of nozzles being positioned to coincide with a locus of substantially uniform vibrational amplitude of said membrane.

According to yet another aspect of the invention there is provided a method of operating a droplet generator including a stimulator plate for generating a plurality of streams of liquid droplets and means for supplying liquid to the stimulator plate, the stimulator plate being substantially two-dimensional and including a flexible membrane having a plurality of nozzles extending therethrough, the nozzles being arranged in a line, and at least one actuator means for vibrating the membrane, wherein during operation the membrane is vibrated such that said line of nozzles coincides with a locus of substantially uniform vibrational amplitude of said membrane.

The present invention further provides a droplet generator for use in a continuous ink jet printer, the droplet generator including a stimulator plate for generating a plurality of streams of ink droplets, and means for supplying ink to the stimulator plate, wherein the stimulator plate is substantially two dimensional, having one dimension smaller than the other two and less than the wavelength of bending waves propagating in the direction of that dimension at the operating frequency. It includes a flexible plate membrane having a plurality of nozzles extending therethrough, the nozzles being arranged in a line positioned to coincide with a locus of substantially uniform vibrational displacement amplitude, and at least one actuator means mounted on said flexible plate membrane to drive the stimulator plate into vibration at or near a resonant frequency thereby generating vibrations in the flexible plate membrane having a stationary spatial distribution of displacement amplitudes and relative phase. Advantageously, the flexible plate member comprises a substrate member and a flexible member bonded together, the plurality of nozzles extending through the said flexible member.

Preferably, the stationary spatial distribution of vibrational displacement amplitude and relative phase of the flexible plate member provides at least one antinode or antinodal line in that portion of the flexible member that, in use, is contacted by the ink. The term "antinodal line" means a point or a locus of points vibrating in phase whose displacement amplitude is a local maximum when traversed in at least one direction across the surface of the membrane. The line of nozzles is preferably positioned adjacent or on an antinodal line of the stationary spatial distribution of displacement amplitude and relative phase of the flexible plate member.

Figure 3:
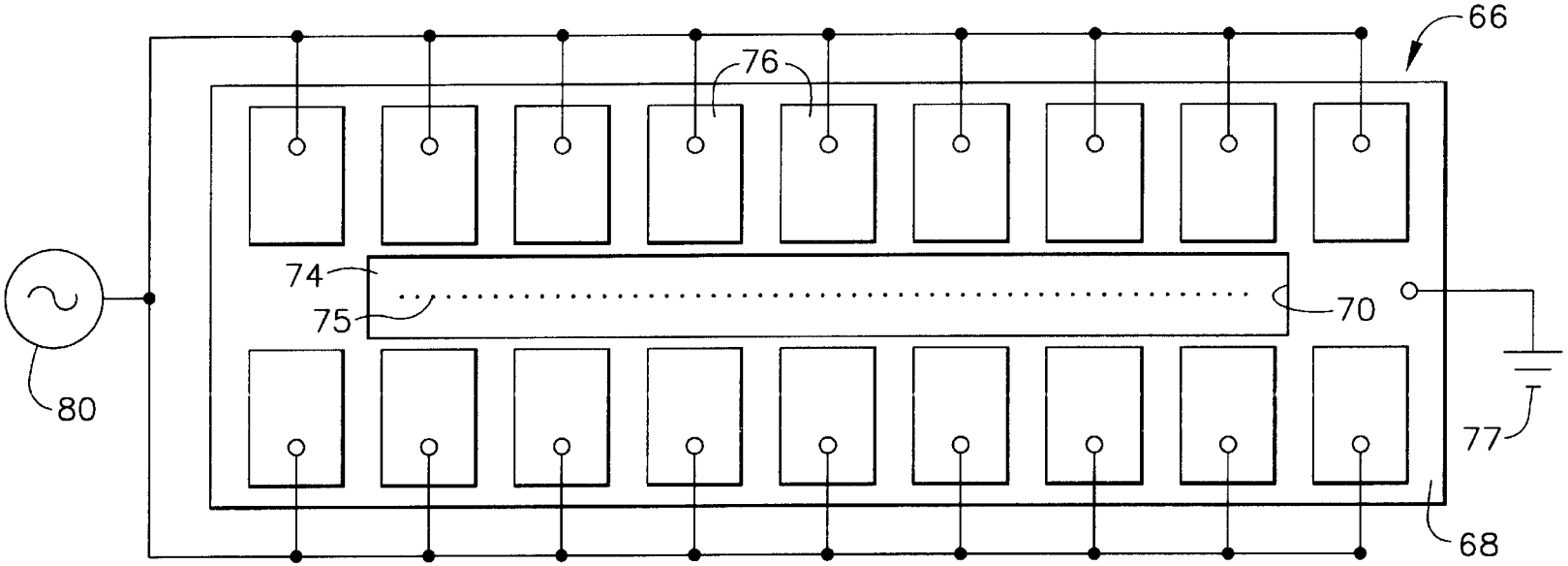
FIG. 3 is a view from underneath of one form of a stimulator plate for the droplet generator.
Figure 4:
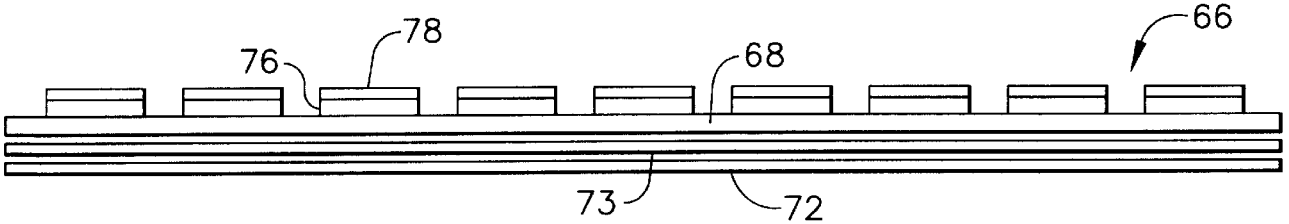
FIG. 4 is an exploded side view of the stimulator plate shown in FIG. 3.
Figure 5:
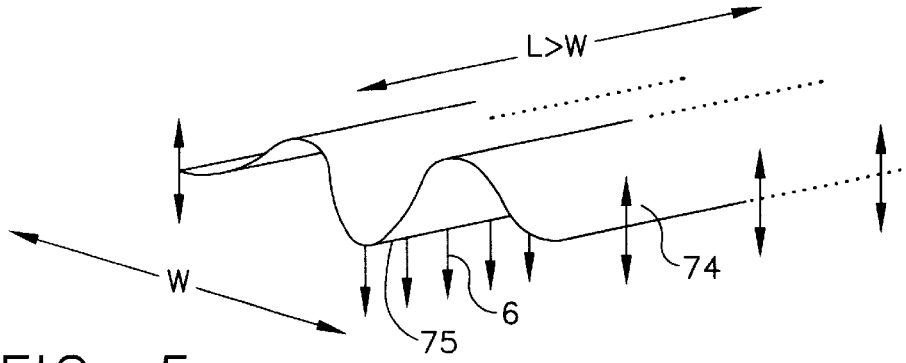
FIG. 5 is a perspective view of a vibrating membrane, illustrating diagrammatically a standing wave generated in the membrane.

Referring now to the drawings, in FIGS. 1 and 3, a CIJ printer conventionally prints onto a print substrate 2 that moves below a droplet generator (or print head) 4 in the direction of arrow A. The print substrate 2 may for example be a strip of paper or foil or a line of goods moving along a conveyor.

A line of nozzles (not shown) is provided in the lower face of the droplet generator 4. The line extends substantially perpendicular to the direction of movement A. Parallel jets of ink, which break up into streams of ink droplets 6, emerge from the nozzles. Some of the droplets are deflected by an electric field and delivered through a line 8 to an ink management system (or IMS) 10, which conditions the ink before recycling it to the droplet generator 4 through line 12 for re-use. The droplets 6 that are not deflected continue in a straight line to strike the print substrate 2, thereby producing a printed image 14 as the substrate moves along. Operation of the droplet generator 4 is controlled by an electronic control unit 16.

Figure 2:
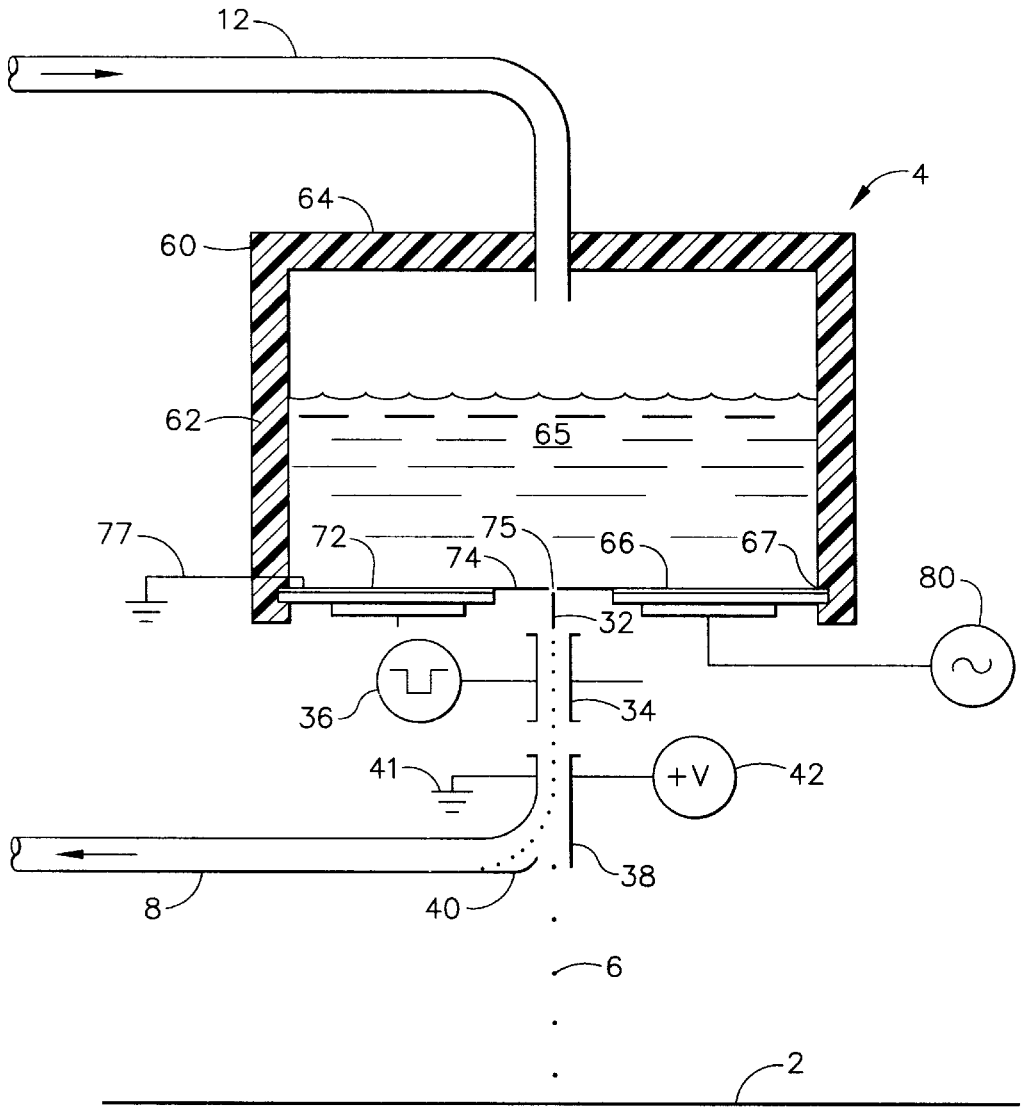
FIG. 2 is a cross-sectional side view of a droplet generator and the droplet deflection apparatus of a CIJ printer.

An array of droplet deflection devices is provided below the droplet generator 4, one such droplet deflection device being provided for each ink jet 32. As shown in FIG. 2, each droplet deflection device comprises a pair of charging electrodes 34 that are located on either side of the ink jet 32, approximately at the point where the jet breaks up into droplets. The charging electrodes 34 are connected to an electronically controlled pulse generator 36.

Below the charging electrodes 34, a deflection electrode 38 is provided on one side of the ink jet 32 and an ink gutter 40 is provided on the other side. The ink return line 8 for returning unused ink to the IMS 10 is connected to the gutter 40. The deflection electrode 38 is connected to a positive high voltage supply 42 and the gutter 40 is connected to an earth 44.

If, during use, a negative pulse potential is applied to the charging electrodes 34 as an ink droplet is breaking off the ink jet 32, a separation in charges will occur in the jet which will result in the droplet carrying a positive electrostatic charge. The charged droplet will subsequently be deflected into the gutter 40 by the electric field between the gutter 40 and the deflection plate 38. If an electrical pulse is not applied to the charging plates 34 as the droplet is formed, the droplet will remain uncharged and will continue in a straight line past the deflection electrode 38 to strike the print substrate 2. The delivery of ink droplets to the print substrate 2 can therefore be controlled electronically by delivering electrical pulses to the charging plates 34.

The droplet generator 4 will now be described in detail with reference to FIGS. 2 to 6. The droplet generator 4 comprises a hollow cuboidal manifold block 60 having four walls 62 and a top 64. The manifold block 60 may, for example, be a molded plastics component and may have a high acoustic damping factor. The hollow interior of the manifold block serves as a reservoir for ink 65, which is fed under pressure to the reservoir from the IMS 10 through supply line 12.

The lower face of the droplet generator 4 is shown comprising a rectangular stimulator plate 66, which is mounted in a groove 67 formed on the internal surfaces of the walls 62. The stimulator plate 66 comprises a rectangular stainless steel substrate 68 having a length of approximately 120 mm, a width of approximately 25 mm and a thickness of about 200 microns. An elongate rectangular orifice 70 having a length of approximately 80 mm and a width of approximately 5 mm is formed in the center of the substrate 68.

A foil 72 of electro-formed nickel having a thickness of about 50 microns is bonded to the upper surface of the substrate 68 by a layer of adhesive 73 having damping characteristics. The adhesive may, for example, be a two-part epoxy or thermoset plastic such as NUCREL™ (manufactured by DuPont). The central part of the foil 72, which extends freely over the orifice 70, forms a flexible membrane 74 having a length L of approximately 80 mm and a width W of approximately 5 mm. A line of nozzles 75 of length approximately 70 mm extends along the longitudinal axis of the membrane 74. The nozzles 75 have a diameter of approximately 30 microns and are spaced at least 40 microns apart.

In the illustrated embodiment, eighteen piezoelectric ceramic transducers 76, each having a thickness of about 250 microns, are bonded to the lower surface of the substrate 68, nine transducers being provided on each of its longer sides. The transducers 76 may be located in shallow depressions, typically 30–50 microns deep, provided in the surface of the substrate. The stainless steel substrate 68 forms an upper electrode for the ceramic transducers 76 and is connected to an earth 77. A drive electrode 78 is formed on the lower surface of each transducer 76. The drive electrodes 78 are connected in parallel to an a.c. drive circuit 80 in the electronic control unit 16.

During use, ink is supplied under pressure to the reservoir, causing jets of ink to be ejected from the nozzles. An alternating potential having a determined amplitude, phase and frequency, is applied to the drive electrodes 78, which causes the piezoelectric transducers 76 to expand and contract in the plane of the substrate 68. This causes the substrate 68 to flex up and down about its longitudinal axis, thereby causing the membrane 74 to vibrate vertically. This causes the jets of ink to break up into fine streams of ink droplets.

By driving the transducers at or near a resonant frequency of the stimulator, a stationary spatial distribution of displacement amplitude and relative phase (for example a standing wave) can be produced in the membrane 74. In a desired resonant mode, illustrated diagrammatically in FIG. 5, the standing wave includes a set of nodal lines that extend parallel to the longitudinal axis of the membrane 74. The antinodal line of maximum amplitude is substantially coincident with the longitudinal axis of the membrane 74, collinear with the line of nozzles 75. This mode of resonance will be referred to herein as a transverse resonant mode.

When the membrane is vibrating in a desired transverse resonant mode, the nozzles 75 vibrate vertically, with the same frequency and substantially the same phase and displacement amplitude. Substantially identical pressure modulations are therefore generated in the ink adjacent the nozzles 75. Together with a constant bias pressure applied to the ink 65, these pressure modulations control the formation of ink droplets. Identical streams of droplets are therefore ejected from the nozzles 75, the frequency of droplet production being equal to the vibrational frequency of the membrane 74.

Providing a set of, for example nine, transducers on each side of the substrate ensures that energy is coupled uniformly into the desired transverse resonant mode all along the length of the stimulator plate. Undesired modes, such as longitudinal resonant modes (in which the membrane flexes about a transverse axis), are not driven directly and are therefore attenuated by energy losses within the system. The provision of a damping layer 73 between the foil 72 and the substrate 68 helps to damp any such unwanted vibrations.

Figure 6:
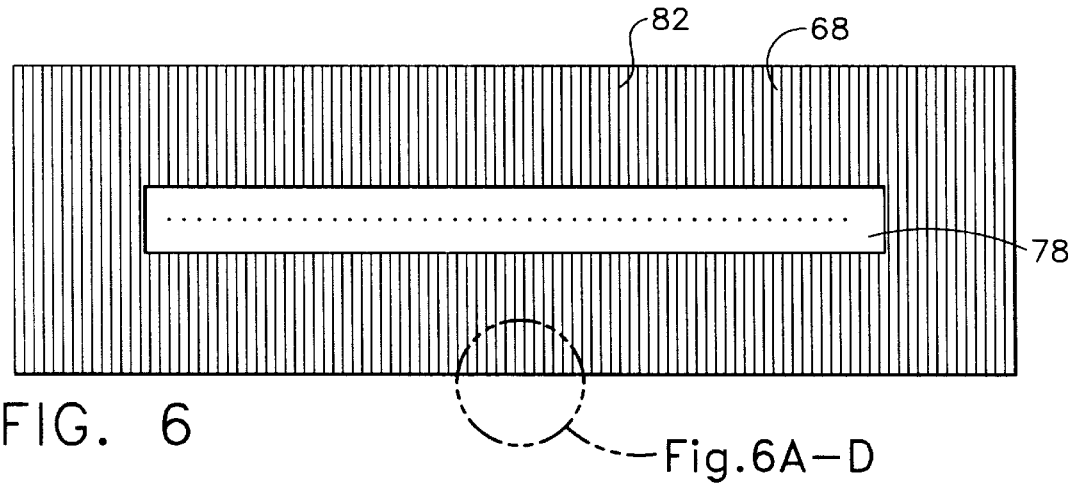
FIG. 6 is a view from underneath of a second type of stimulator plate.
Figure 6A:
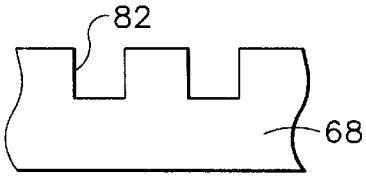
Figure 6B:
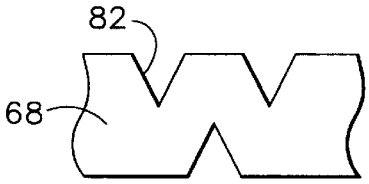
Figure 6C:
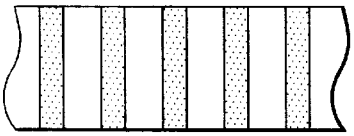
Figure 6D:
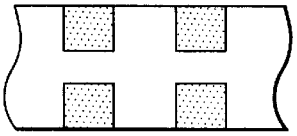

Undesired longitudinal resonant modes may be further inhibited by using ultrasonically anisotropic materials, in which the speed of bending waves is higher in the transverse direction than in the longitudinal direction. This may be achieved by, for example, forming a number of transverse grooves 82 in the upper and/or lower surface of the substrate 68 as shown in FIGS. 6*a*, 6*b* and 6*c*, which illustrate examples of grooves that have been filled with a lossy viscoelastic material such as PIB or a bituminous compound, most effectively incorporating a filler material in the form of, for example, small particles of glass. In FIG. 6*d* there is illustrated a laminated structure comprising a plurality of stainless steel ribs alternating with vulcanized rubber binders.

The grooves 82 increase the flexibility of those parts in the longitudinal direction. This reduces the resonant frequency for longitudinal resonant modes and so helps to inhibit the formation of those modes at normal operating frequencies.

The thickness of the stimulator plate in the nozzle-bearing region of the plate satisfies the inequality:

$$\sum_i \left(\frac{t_i}{c_i}\right) < \frac{1}{f}$$

where $t_i$ is the thickness of the ith layer of material in the stimulator plate and $c_i$ is the speed in that layer, at the operating frequency f, of either compressional or shear waves propagating the layer in the direction of its thickness. Preferably, the right-hand side of the inequality is 1 /2 f. This definition ensures that the device is thin enough not to support waves traveling in its thickness direction. It does not restrict waves of any kind traveling in other directions.

Figure 7:
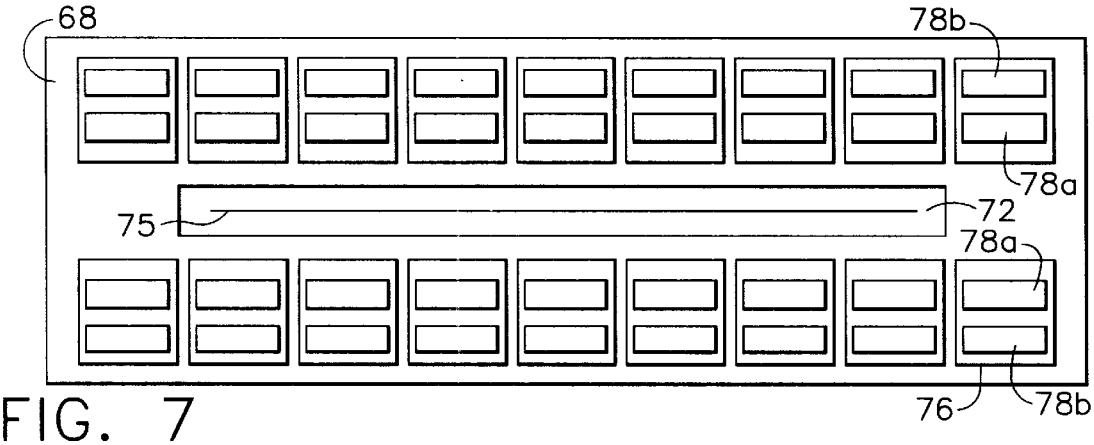
FIG. 7 is a view from underneath of a third type of stimulator plate.
Figure 8:
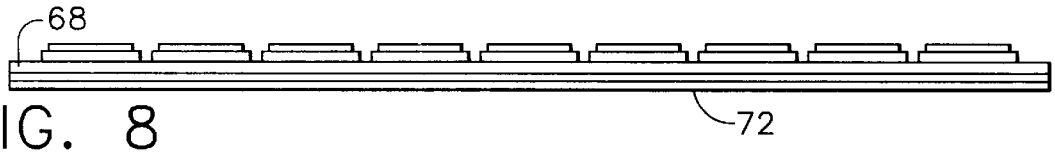
FIG. 8 is a side view of the third type of stimulator plate.
Figure 9:
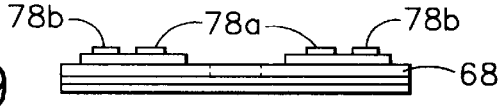
FIG. 9 is an end view of the third type of stimulator plate.
Figure 14:
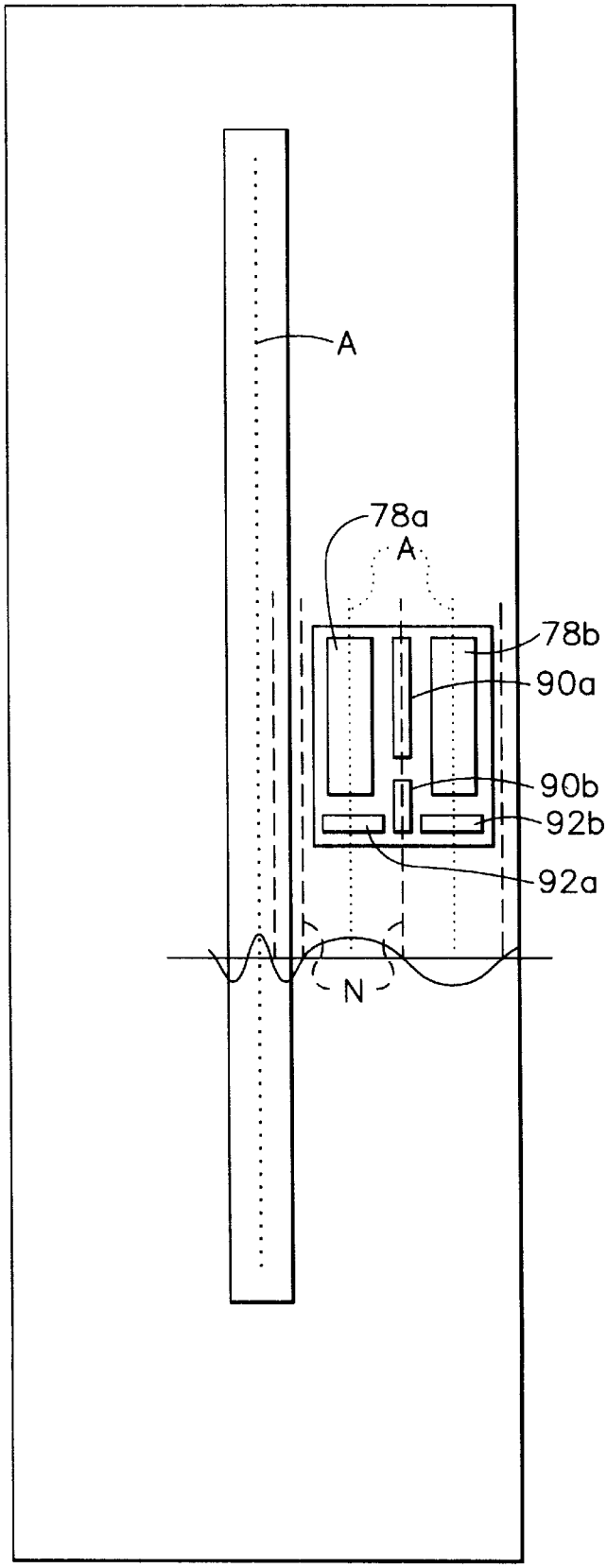
FIG. 14 is a view from underneath of a sixth type of stimulator plate.

FIGS. 7 to 9 illustrate a third type of stimulator plate 66, in which two drive electrodes 78*a* and 78*b* are provided on each transducer 76, those electrodes comprising metallic strips that extend parallel to the line of nozzles 75. The drive electrodes 78*a*, 78*b* are located and preferably centered on adjacent antinodal lines (as illustrated in FIG. 14) and are connected to the a.c. drive circuit 80 so as to receive drive signals of opposite polarity. This encourages the substrate 68 to adopt the desired transverse resonant mode by coupling energy more efficiently into that mode than into any other undesired mode.

Figure 10:
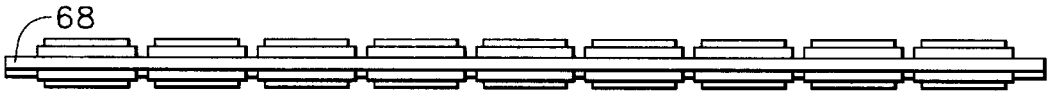
FIG. 10 is a side view of a fourth type of stimulator plate.
Figure 11:
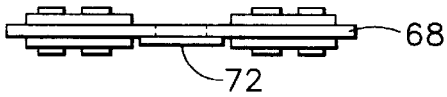
FIG. 11 is an end view of the fourth type of stimulator plate.

FIGS. 10 and 11 illustrate a fourth type of stimulator plate 66, in which piezoelectric transducers 76 are provided on both sides of the stimulator plate 66. The foil 72 is bonded to the lower face of the stainless steel substrate 68 and is sufficiently narrow to fit between the two rows of transducers 76 that are bonded to that face. The two sets of drive electrodes are connected to the a.c. drive circuit 80 so as to receive drive signals of opposite polarity, so that they drive the stimulator plate 66 in unison.

Figure 12:
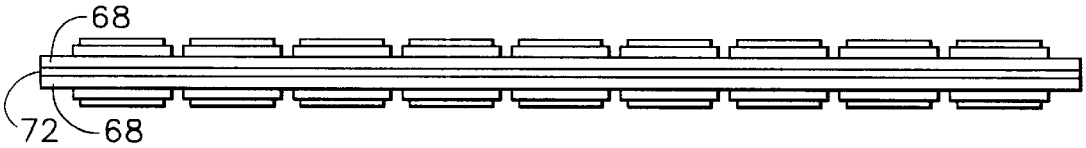
FIG. 12 is a side view of a fifth type of stimulator plate.
Figure 13:
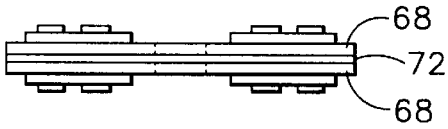
FIG. 13 is an end view of the fifth type of stimulator plate.

FIGS. 12 and 13 illustrate a fifth type of stimulator plate 66, in which piezoelectric transducers 76 are provided on both sides of the stimulator plate 66. The stimulator plate 66 is constructed in the form of a sandwich comprising two rectangular stainless steel substrates 68 that are bonded to opposite faces of the foil 72. The two sets of drive electrodes are connected to the a.c. drive circuit 80 so as to receive drive signals of opposite polarity, so that they drive the stimulator plate 66 in unison.

The a.c. drive circuit 80 may employ either open-loop or closed-loop control. Open-loop control is provided simply by driving the transducers 76 with a signal having a fixed frequency and amplitude. In closed-loop control, feedback is used to provide compensation for changes in operating conditions, such as fluctuations in temperature. This may be achieved by providing one or more sensing transducers on the stimulator plate to provide voltage amplitude and phase feedback to control the drive signal. Alternatively, control electronics may be provided that can detect impedance changes, either in magnitude or phase, in the electrical load presented by the drive transducers. In this case, sensing transducers are not required on the stimulator plate.

FIG. 14 illustrates an example of a stimulator plate 66 in which sense electrodes 90 and 92 are provided on the lower surface of the transducers 76 (for clarity, only one transducer is shown). Two sets of sense electrodes are provided, the first set 90 comprising a pair of elongate electrodes that extend parallel to the longitudinal axis of the substrate and are located on a nodal line between the two drive electrodes 78*a* and 78*b*. The first set of sense electrodes 90 is sensitive to longitudinal vibrations of the stimulator plate 66 and substantially insensitive to transverse vibrations. The second set 92 of sense electrodes comprises a pair of elongate electrodes that extend perpendicular to the longitudinal axis of the substrate. The second set of sense electrodes 92 is sensitive to transverse vibrations of the stimulator plate 66 and substantially insensitive to longitudinal vibrations.

The sense electrodes 90 and 92 are connected electrically to the electronic control unit 16. As the substrate 68 flexes, electrical potentials are generated by strains in the transducers 76 and these potentials are sensed by the sense electrodes 90 and 92. The sense electrodes 90,92 thus provide a set of feedback signals that can be used by the electronic control unit 16 to monitor flexing of the substrate 68.

If unwanted longitudinal modes of resonance are detected, the phase and/or amplitude of the drive signals delivered to the drive electrodes 78 can be modified to counteract the unwanted components of the vibrations. As the acoustic impedance of the drive transducers 76 is comparable to the acoustic impedance of the resonant body (i.e. the stimulator plate 66), the transducers are able to exert a significant and direct influence on its vibrations and can thus directly modify the mode of resonance. This is unlike the present CIJ generators in which there is a very large mismatch between these impedances.

Alternatively, each transducer may be provided with a secondary mode driver electrode in addition to the primary drive electrode and the sense electrode. If unwanted longitudinal modes of resonance are detected, the electronic control unit can send appropriate drive signals to the mode driver electrodes, to counteract the unwanted components of the vibrations. Separate or integrated electronic control circuits may be provided for this purpose. The drive signals delivered to the primary drive electrodes are not adjusted in this case.

Figure 15:
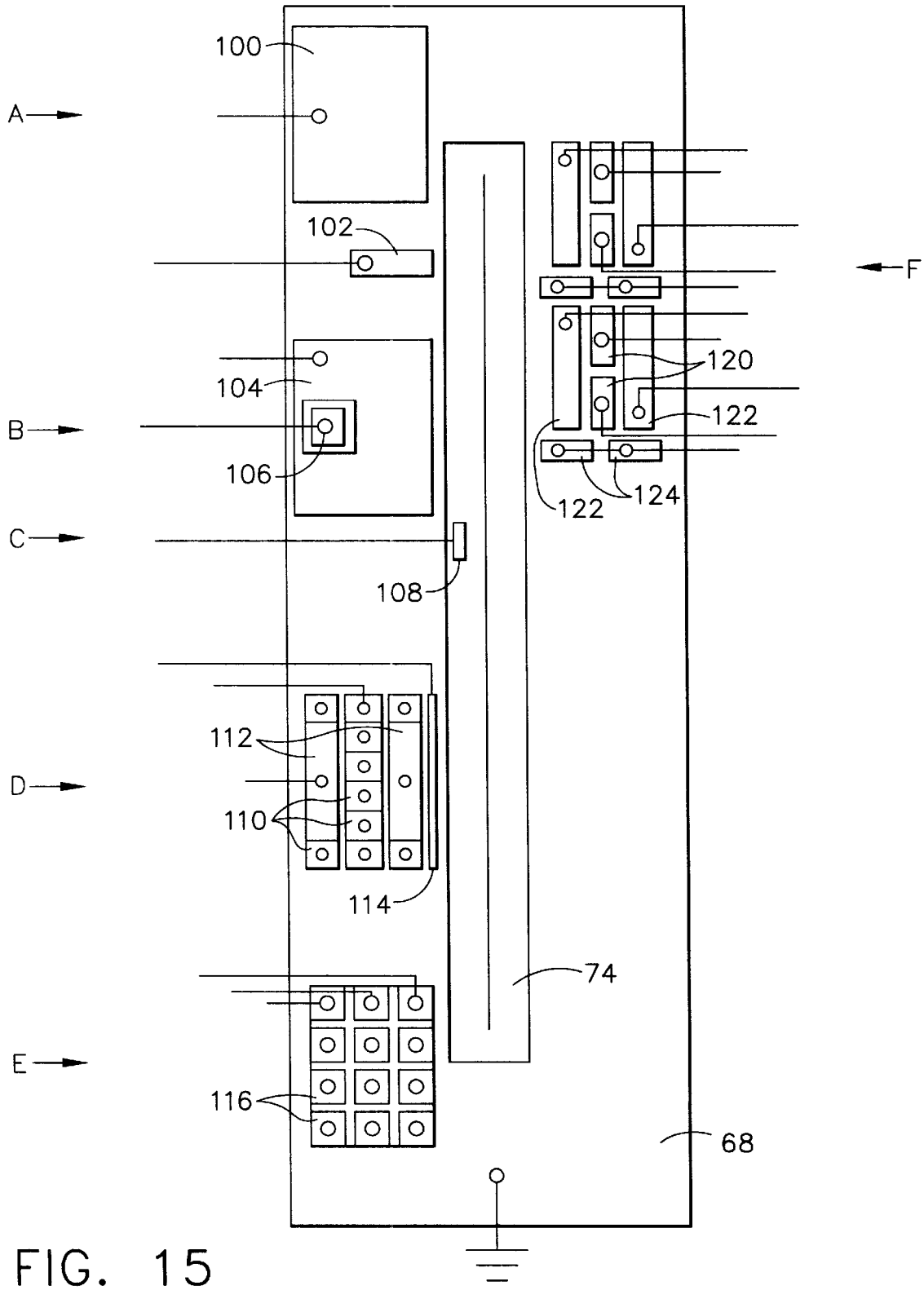
FIG. 15 is a view from underneath of a stimulator plate, illustrating various alternative configurations for the actuators and the drive/sense electrodes.

Various possible transducer/sensor/electrode configurations are illustrated by way of example in FIG. 15. It should be understood that any specific device will typically comprise only a small subset of these possible configurations, which will be laid out in a chosen pattern on the substrate. The possible configurations include the following:

A a drive transducer 100 with a sensor 102 provided on a separate piezoelectric transducer;

B a drive transducer 104 and a sense electrode 106 provided on a single piezoelectric transducer;

C a drive transducer 100 and a separate sensor 108 formed on the membrane 74;

D an array of drive electrodes 112 and sense electrodes 110 provided on a single piezoelectric transducer, together with a separate sense transducer 114;

E an array of drive electrode 116 provided on a single piezoelectric transducer; and F an array of transverse drive electrodes 122, longitudinal mode sense electrodes 120 and transverse mode sense electrodes 118 provided on a single piezoelectric transducer.

Figure 16:
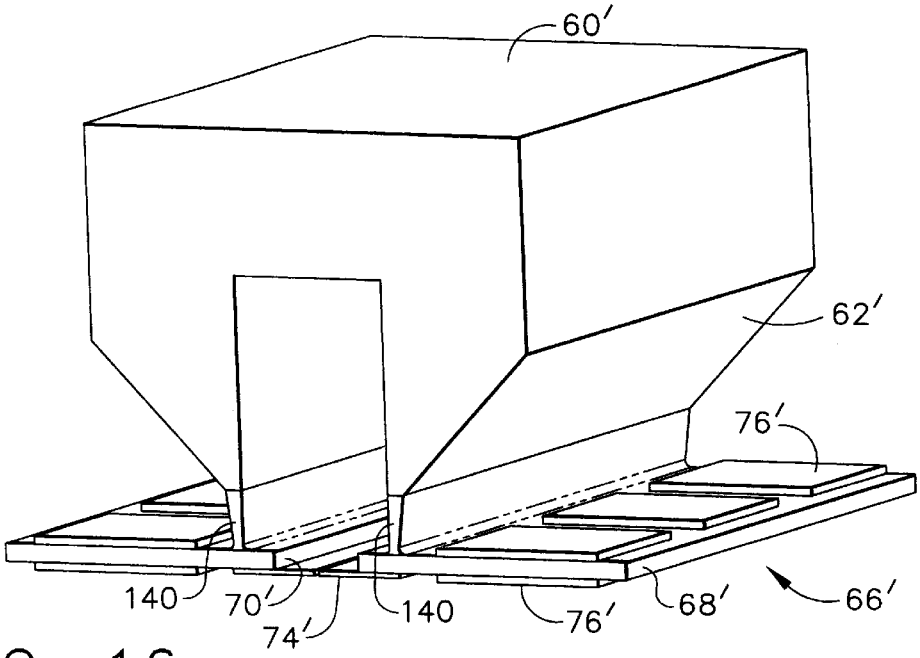
FIG. 16 is a perspective view of a second type of droplet generator.
Figure 17:
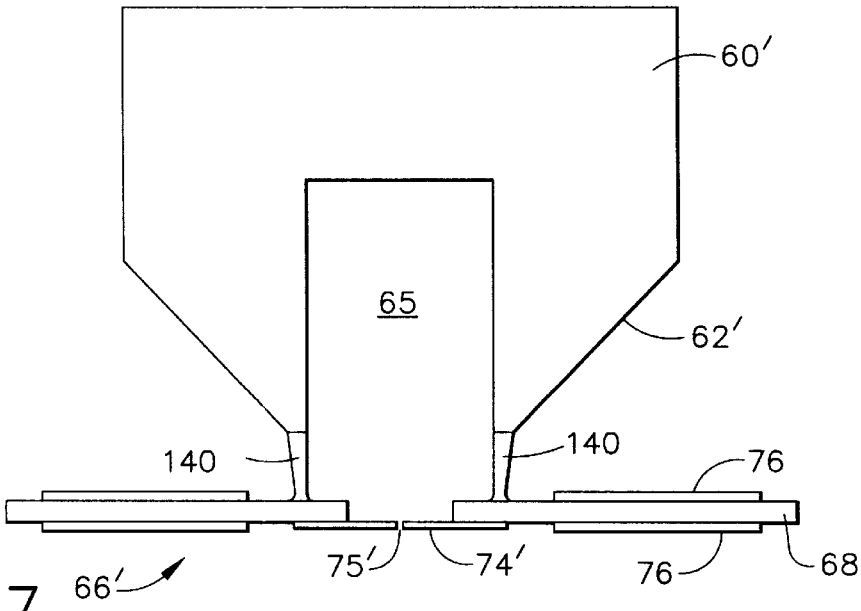
FIG. 17 is an end view of the second type of droplet generator.

In a second type of droplet generator shown in FIGS. 16 and 17, the manifold block 60' is narrower than in the first type and the side walls 62' are tapered towards their lower edges. The side walls 62' are connected by means of thin connecting walls 140 to the upper surface of the stainless steel substrate 68' on either side of the orifice 70', so that the piezoelectric ceramic transducers 76' lie outside the connecting walls 140. In this embodiment, two sets of transducers 76' are provided, one set being bonded to the upper surface of the substrate 68' and the other set being bonded to its lower surface.

The second type of droplet generator is capable of operating with a greater bias pressure applied to the ink 65 in the manifold block 60. This is because the part of the substrate 68' that carries the transducers 76' lies outside the connecting walls 140 and does not therefore bow significantly when a bias pressure is applied to the ink. This is important since excessive bowing of the substrate can cause the transducers to crack or become detached from the substrate. The connection points of the side walls with the substrate are also much closer together than in the first type of droplet generator, which reduces substantially the degree of deformation of the membrane when the ink in the chamber is pressurized. The lines of contact between the substrate and the connecting walls are positioned substantially along nodal lines of the vibration of the substrate. This helps both to localize these particular nodal lines in the substrate and to minimize the acoustic energy lost from the substrate to the connecting walls.

In use, the vibrations produced by expansion and contraction of the transducers 76' are transmitted to the membrane 74', resulting in vibration of the nozzles 75'. Streams of droplets emerge from the nozzles as a result of those vibrations and the bias pressure applied to the ink.

Various modifications of the droplet generators described above are possible. For example, any number of piezoelectric transducers may be provided and generally the provision of more transducers will allow for improved suppression by 'active damping' as described above of unwanted resonance modes. The piezoelectric transducers may also be replaced by other types of transducer, such as electrostrictive or magnetostrictive transducers. Also, the stainless steel substrate 68 may itself be replaced by a suitable transducer, thereby allowing the vibrational amplitude of the stimulator plate 66 to be increased. Furthermore, the membrane need not be perfectly rectangular. For example, the ends (the shorter sides) of the membrane may be curved or angled.

It is also possible that more than one line of nozzles may be provided. It is preferable that all the nozzles are subjected to substantially identical vibrations. This may be achieved, for example, by providing lines of nozzles on either side of an antinodal line, at loci of equal vibrational amplitude. For example, parallel lines of nozzles may be provided on either side of the central antinodal line. Furthermore, it is possible that the substrate may be omitted completely, the actuators then being mounted directly on the flexible membrane so that the droplet generator comprises a two-part structure. The three-part structure described above may, in fact, be regarded as a variation on such a two-part structure.

Finally, the droplet generator may have applications other than as a print head in a continuous ink jet printer.

The invention has been described in detail with particular reference to certain preferred embodiments thereof, but it will be understood that modifications and variations can be effected within the spirit and scope of the invention.

What is claimed is:

1. A droplet generator for generating streams of ink droplets in a continuous ink jet printer, comprises:

a flexible stimulator plate having a plurality of nozzles that extend through the plate from one face to an opposite face thereby creating a nozzle-bearing region in the plate, said nozzles being arranged in at least one substantially rectilinear line, and said stimulator plate being mounted on a manifold having a cavity for supplying ink to the stimulator plate;

means for supplying ink under pressure to the nozzle-bearing region of the stimulator plate; and actuator means for generating bending vibrations in the stimulator plate, said actuator means having at least one electromechanical transducer that is arranged to expand and contract in a direction parallel to a plane of the stimulator plate, and said stimulator plate having an inner nozzle-bearing part and a peripheral part on which said actuator means is mounted, said manifold being attached to the stimulator plate between said inner and peripheral parts, the plurality of nozzles being located to coincide, during use, with a locus of substantially uniform vibrational amplitude and phase, whereby substantially identical streams of ink droplets are ejected from the nozzles.

2. A droplet generator as claimed in claim 1 wherein the stimulator plate is substantially rectangular and the plurality of nozzles extends parallel to a longitudinal axis of the stimulator plate.

3. A droplet generator as claimed in claim 1 wherein the stimulator plate comprises:

sensing means for sensing flexure of the stimulator plate; and drive means for driving the actuator means; and has connected thereto control means for controlling the drive means responsive to the sensed flexure of the stimulator plate.

4. A droplet generator as claimed in claim 1 wherein the stimulator plate comprises vibration damping materials.

5. A droplet generator as claimed in claim 1 wherein the stimulator plate comprises anisotropic acoustic properties.

6. A droplet generator as claimed in claim 1 wherein the manifold comprises vibration damping materials.

* * * * *